US006478022B2

(12) United States Patent
Robinson et al.

(10) Patent No.: US 6,478,022 B2
(45) **Date of Patent: *Nov. 12, 2002**

(54) SELF-CONTAINED CAMP HEATER

(75) Inventors: Edgar C. Robinson, Vancouver (CA); Leonard Fleming, Richmond (CA)

(73) Assignee: International Thermal Investments Ltd., Richmond (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/060,862

(22) Filed: Apr. 15, 1998

(65) Prior Publication Data

US 2001/0042544 A1 Nov. 22, 2001

(51) Int. Cl.[7] ..... F24C 1/16

(52) U.S. Cl. ..... 126/59; 126/93; 431/64; 431/333

(58) Field of Search ..... 126/93, 96, 95, 126/307 R, 59; 431/343, 333, 38, 39, 64

(56) References Cited

U.S. PATENT DOCUMENTS

| | | | | | |
|---|---|---|---|---|---|
| 34,546 | A | * | 2/1862 | Chandler et al. | 126/59 |
| 37,043 | A | * | 12/1862 | Kingsland | 126/59 |
| 523,920 | A | * | 7/1894 | Sinclair | 126/307 R |
| 3,367,318 | A | * | 2/1968 | Murakami et al. | 126/96 |
| 3,620,657 | A | * | 11/1971 | Robinson | 431/9 |
| 4,774,931 | A | * | 10/1988 | Urso | 126/85 B |
| 4,896,655 | A | * | 1/1990 | Urso | 126/59 |
| 5,033,956 | A | * | 7/1991 | Nystrom | 431/11 |
| 5,121,739 | A | * | 6/1992 | Barker | 126/248 |
| 5,445,137 | A | * | 8/1995 | Crews | 126/59 |
| 5,527,180 | A | * | 6/1996 | Robinson et al. | 431/258 |
| 5,549,470 | A | * | 8/1996 | Henderson | 126/96 |
| 5,690,094 | A | | 11/1997 | Steinfeld et al. | |
| 6,109,912 | A | * | 8/2000 | Robinson et al. | 126/95 |

FOREIGN PATENT DOCUMENTS

| | | | | |
|---|---|---|---|---|
| CH | 543 265 | | 10/1973 | |
| DE | 3433500 | * | 3/1986 | 5/20 |
| DE | G9101813.7 | | 2/1991 | |
| DE | G9106348.5 | | 5/1991 | |
| FR | 1404490 | | 4/1994 | |
| GB | 1 446 895 | | 8/1976 | |

* cited by examiner

*Primary Examiner*—Sara Clarke
(74) *Attorney, Agent, or Firm*—John Russell Uren

(57) ABSTRACT

Self contained and transportable camp heater with a burner within a casing and a fuel tank operably connected to the burner. A stack is removably mounted on the casing and is positioned on a holder with the casing and the fuel tank after removal for transportation purposes. A regulator is operably connected to the fuel tank and, thence, to the burner. The regulator is conveniently a zero pressure regulator.

6 Claims, 2 Drawing Sheets

SELF-CONTAINED CAMP HEATER

INTRODUCTION

This invention relates to a camp heater and, more particularly, to a camp heater which is self contained and easily transportable with a-removable stack which will allow byproducts of combustion to escape from the heater to a position outside the enclosed area where the heater is to be operated.

BACKGROUND OF THE INVENTION

There is a need for heat and warmth in virtually every location where individuals work and live. It is desirable to obtain this heat in a convenient manner, particularly where the working and/or living location changes frequently, such as in respect of military operations. A further benefit is that the heater will be assembled relatively quickly and easily at the new location.

Heretofore, in the event tents or temporary living accommodations are provided, the interior heating apparatus typically consisted of a heater located within the tent or enclosure. Fuel was provided from a fuel tank located outside the tent and a stack was installed with some difficulty and extended from the heater to a position outside the enclosure for safety reasons. The assembly of the various components into an operating heater was time consuming and fuel was generally supplied from another source that, if missing, would not allow operation of the heater. When a new operating location was intended, the disassembly of the heater and its transportation in various segments was time consuming and inconvenient.

SUMMARY OF THE INVENTION

According to one aspect of the invention, there is provided a self-contained camp heater comprising a transportable holder, a fuel tank and a casing mounted on said holder and a stack mountable on said holder with said fuel tank and casing, said stack being removable from said holder and connectable to said casing.

According to a further aspect of the invention, there is provided a method of operating a self-contained camp heater in an enclosed location, said method comprising the steps of transporting a holder to said enclosed locations with said holder operably holding a fuel tank, a casing with a burner within said casing and a stack, removing said stack from said holder and installing said stack in said casing, commencing fuel flow from said fuel tank to said burner and initiating combustion of said fuel within said casing.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
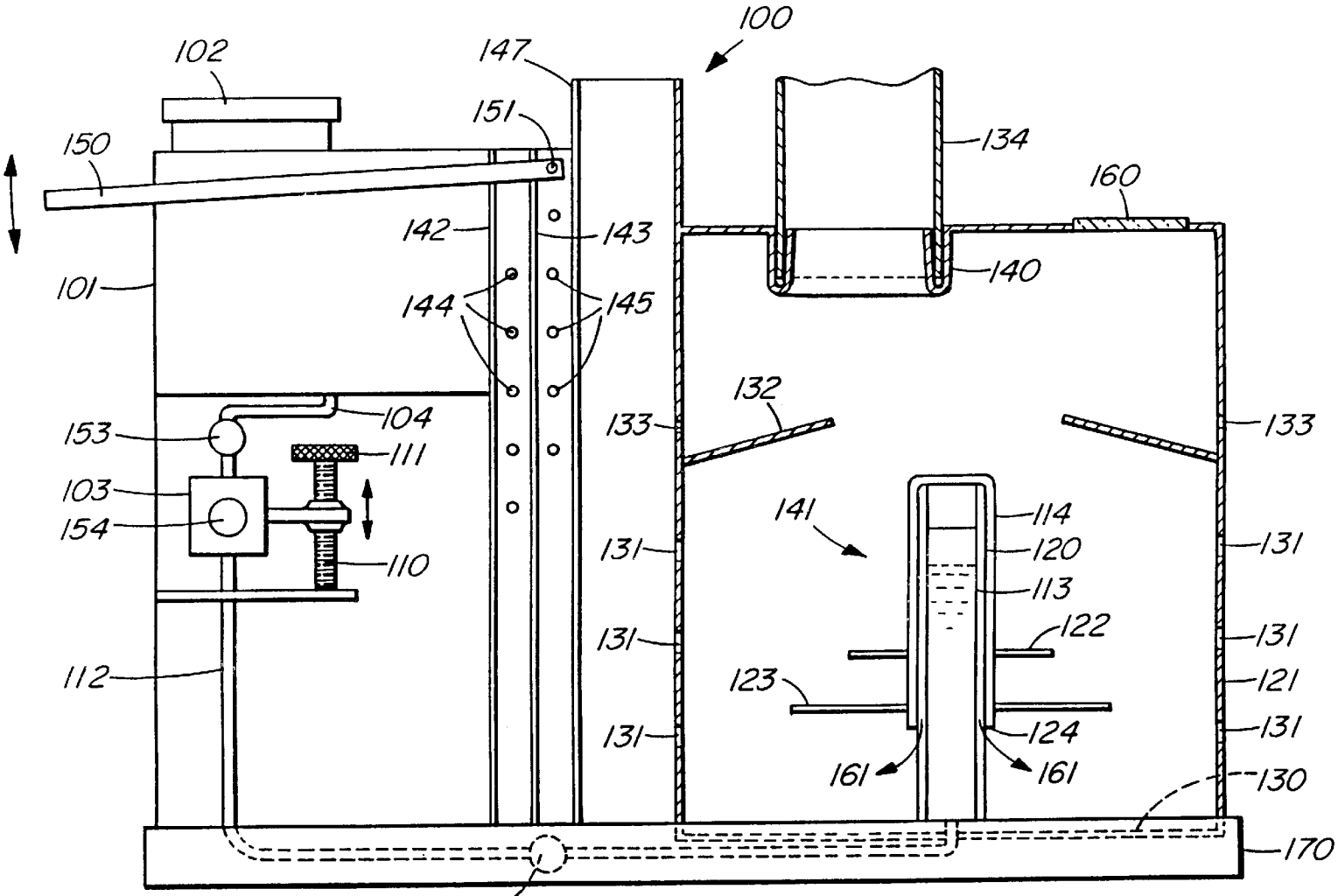
FIG. 1 is a side, diagrammatic partial sectional view of the camp heater according to the invention.
Figure 2:
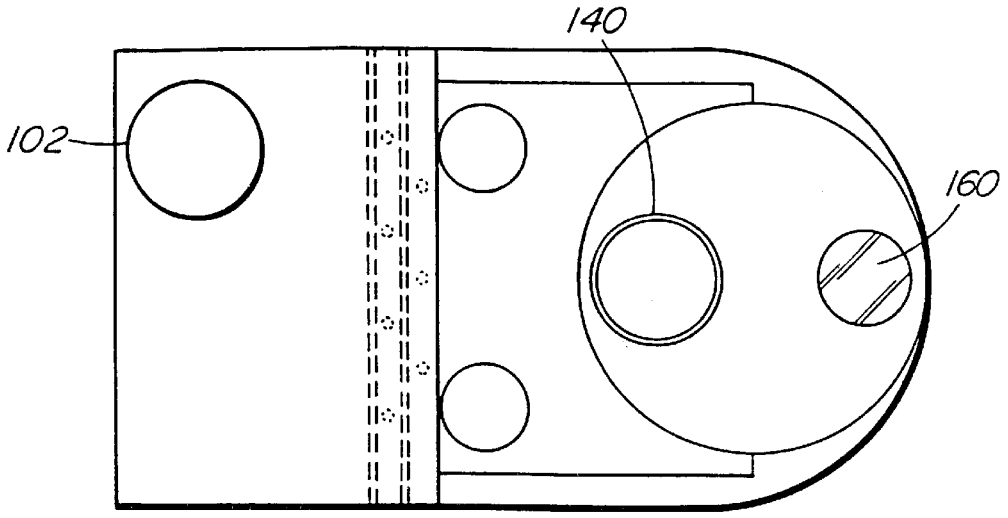
FIG. 2 is a plan view of the camp heater of FIG. 1.

Referring now to the drawings a camp heater according to the invention is generally illustrated at 100 in FIG. 1. It comprises a fuel tank 101 and a burner casing 121 with a removable filler knob 102 threadedly installed to form a fuel entry passageway into the tank 101 so that upon removal, fuel may be added to the tank 101, the fuel used being conveniently JP8, diesel number 1 or fuel of a similar nature. The fuel tank filler knob 102 seals the tank 101 when it is fully tightened as may be the case when the camp heater 100 is being transported. However, when the camp heater 100 is under operation, the filler knob 102 is loosened thereby to allow air to enter the tank 101 and keep the pressure within the tank at or near ambient conditions thereby to allow fuel flow.

A zero pressure regulator 103 is attached by a tube 104 to the fuel tank 101. The zero pressure regulator 103 is a diaphragm type regulator which, when there is no pressure differential, will not allow fuel to enter the regulator 103. When pressure is reduced on one side of the diaphragm (not illustrated), a needle valve (not illustrated) connected to the diaphragm opens and allows fuel to enter the regulator 103. A primer knob 154 is positioned in the zero pressure regulator 103 thereby to allow fuel to flow to the burner as will be described when burner operation is to be initiated.

Zero pressure regulator 103 is mounted on a threaded screw 110 with a knurled knob 111 connected to the upper end of the screw 110. As the knob 111 is rotated, the zero pressure regulator 103 will move upwardly or downwardly as indicated and as desired by the operator thereby to increase or decrease the fuel being provided to the burner as will be described which, in turn, will increase or decrease the heat being produced by the camp heater 100.

A second and downstream tube 112 extends from the outlet of the zero pressure regulator 103 and joins with a burner 141, commonly known as an S-tube burner 141. S-tube burner 141 has a cylindrical circumferential member or downtube 114 which is mounted over the uptube 113 and is separated from the uptube 113 by spacers 120. Spacers 120 act to conduct heat from the combustion of the fuel within the casing 121 to the downtube 114 and thence to the uptube 113 which heat provides the temperature required for vaporization of the fuel within the uptube 113. Downtube 114 has two superheaters 122, 123 mounted around the downtube 114. Superheaters 122, 123 are circular members and surround the downtube 114 as illustrated. The lowermost portion 124 of downtube 114 is located approximately 1½ inches from the floor or base 130 of camp heater 100.

A series of primary air holes 131 are positioned about the circumference of the burner casing 121 to allow for entry of the primary air used in fuel combustion. A high fire ring 132 is connected to the inside circumference of the burner casing 121 and slopes upwardly at approximately a 20 degree angle with secondary air entry holes 133 located on the upper side of the high fire ring 132. It has been found that the slope of the high fire ring 132 is important for proper fuel combustion in the particular application to which the camp heater 100 is directed. If the slope is too small, the combustion in the casing outside the downtube 114 and inside the casing 121 will sputter. If the slope of the high fire ring 132 is too large, the length of the combustion flame will increase which can lead to smoke and inefficient combustion.

A removable window 160 is positioned on the upper end of the casing 121. Window 160 allows observation of the combustion conditions within the casing 121 and also allows the insertion of a burning paper or like product to initiate combustion in the casing 121 when the heater 100 is ignited.

Figure 3:
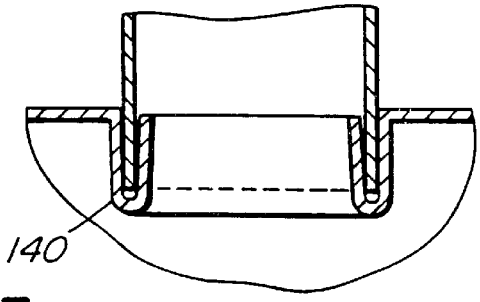
FIG. 3 is a diagrammatic partial sectional view of the collar and stack assembly used on the camp heater of FIG. 1.
Figure 4:
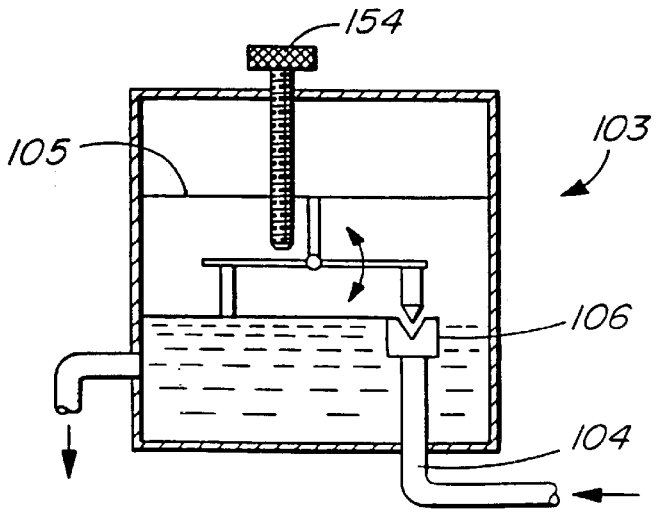

A stack 134 is mounted within the casing 121 to allow for escape of the combustion byproducts such as nitrous oxide, carbon monoxide, carbon dioxide and the like as is well known. Stack 134 is mounted using an internal mounting collar 140 (FIG. 3) which allows entry of the bottom circumference of stack 134 without extensions protruding upwardly from the casing 121 when the stack 134 is removed which extensions are generally sharp and can cause injury and, in any event, which are a nuisance during transportation and in the event the heater 100 is to be packaged. The connection between the stack 134 and the collar 140 is the subject of our U.S. Pat. No. 5,527,180 granted Jun. 18, 1996, the contents of which are incorporated herein by reference.

The stack 134 is extendible; that is, the stack 134 is formed in several pieces which are concentric and which fit within each other. Thus, there may be five(5) pieces of stack 134, each of the pieces being approximately one foot in length and concentrically put together such that when the five(5) pieces are removed and assembled to extend upwardly, the stack may be a length of five(5) feet or so.

The stack 134 is intended to be manually removable from collar 140 and placed between the casing 121 holding the burner generally illustrated at 141 and the fuel tank 101. When the stack 134 is in this position, the camp heater 100 is easily transported. Two spacer plates 142, 143 are positioned between the casing 121 of the burner 141 and the fuel tank 101 with air circulation holes 144, 145 allowing air to circulate between the spacer plates 142, 143. The spacer plates 142, 143 are intended to shield the fuel tank 101 from the heat generated by the casing 121 and thereby to keep the fuel tank 101 cool for safety purposes.

A holder 170 holds the casing 121, fuel tank 101 and stacks 134. A bail or handle 150 is mounted on the fuel tank 101 and rotates about axis 151 as indicated. Bail 150 allows the camp heater 100 to be easily carried and is generally mounted with its axis 151 at a position where the camp heater 100 remains in a substantially vertical position when carried so as to maintain the configuration of heater 100 as when it is in its operating position.

Two valves 152, 153 are provided to stop or allow fuel flow through the lines 112, 104, respectively. The valves 152, 153 are manually operated and prevent or allow fuel to flow through the lines in which they are positioned.

OPERATION

In operation, it will be assumed that the camp heater 100 is being transported. In this condition, the filler knob or fuel cap 102 will be in the fully tightened condition such that no fuel will be allowed to exit from the fuel tank filler tube if the camp heater 100 is inadvertently turned upside down during transportation or mishandled. Likewise, valves 152, 153 will be closed thereby to prevent fuel from travelling to the zero pressure regulator 103 and through fuel line 112 to burner 141 during transportation. Thus, there will be little or no leakage of the fuel during transportation.

Likewise while being transported, the stack 134 will be removed from the casing 121 and located between the fuel tank 101 and the casing 121 as is illustrated in FIG. 1. The entire camp heater 100 will be carried by bail 150 which will be in the upwardly extending position. Thus, the camp heater 100 will be relatively easily transported in a convenient self-contained package.

When the operating location is reached, such as in a tent during military operations in colder weather, the camp heater 100 will be positioned on the floor of the tent or ground surface. The stack 134 will be removed from its position between the fuel tank 101 and the casing 121 and the concentric stack pieces will be separated and assembled end to end. The bottom of the stack 134 will be inserted into collar 140 and the top of the stack 134 will be located outside the tent so as to provide egress for the combustion byproducts during heater operation.

The filler knob 102 will be removed and fuel will be added if required. Filler knob 102 will be refitted and loosely tightened on the fuel tank 101 so that ambient pressure will allow fuel flow from the fuel tank 101. Valves 153, 152 will be opened to allow fuel flow to the zero pressure regulator 103 and to the burner uptube 113.

The primer knob 154 will be pushed which will allow fuel to flow to the burner uptube 113. It is initially intended for the fuel flow created by the primer knob 154 to overflow the burner uptube 113 and be deposited on the floor or base 130 of the casing 121. This is so so that the user or operator may initiate combustion within the casing 121 by lighting the fuel which has overflowed from the burner 141 with a burning paper inserted through window 160. This initiates combustion within the casing 121.

The combustion within casing 121 will create a high temperature on the outside of the downtube 114 of the burner 141. This heat will be transferred through the spacers 120 to the burner uptube 113 which will allow fuel vaporization to occur within the burner uptube 113. As the fuel vaporizes in the uptube 113, it will travel in a gaseous state downwardly in the circumference between uptube 113 and downtube 114 and exit the circumference at the bottom as is illustrated by arrows 161. The vapor will be ignited within the casing 121 and combustion will continue with the heat generated within the casing 121 being used for heating the tent and with the byproducts exiting from the tent through the stack 134.

The level of the fuel within the uptube 113 is regulated by the zero pressure regulator 103. By raising or lowering the level of the fuel in the uptube 113, the combustion can be increased or decreased. However, vaporization of the fuel will only occur within the uptube 113 to avoid liquid overflow from the uptube 113. If the fuel level is higher, increased heat will result and if the fuel level is lower, reduced heat will result. Thus, the operator need only rotate knurled knob 111 to raise or lower the zero pressure regulator 103 thereby to raise or lower the fuel level within the uptube 113.

If it is desired to terminate operation of the camp heater 100, the operator will simply close valve 152 which will terminate fuel flow to the uptube 113. This will then cease the vaporization of the fuel within the uptube 113 and the combustion will terminate.

Instead of the s-tube configuration for the uptube 113 described and illustrated for the burner 141, an r-tube configuration (not illustrated) could be utilised. The r-tube configuration has an uptube in which the fuel is vaporized similarly to the vaporization which takes place in the s-tube configuration described. However, rather than the vapor traveling down around the circumference of the uptube, the uptube is provided with a cap which directs the vapor into a separate downtube where the vapor exits into the casing where combustion of the vaporized fuel again occurs.

Rather than the regulator being a zero pressure regulator, a carburetor may be conveniently used. The use of a carburetor is particularly attractive where the installation of the heater 100 is intended to be relatively permanent so that fuel spillage during transportation is not a principal consideration.

Many further modifications will readily occur to those skilled in the art to which the invention relates and the specific embodiments described should be taken as illustrative of the invention only and not as limiting its scope as defined in accordance with the accompanying claims.

What is claimed is:

1. A self-contained camp heater comprising a fuel tank, a holder, a burner located within a casing, a stack mountable on said casing and being removable therefrom, said stack being extendable in individual segments from said casing and acting to conduct combustion by-products from said heater to a desired location, each of said segments of said stack being removable from each of said other segments of said stack, each of said segments being positioned on and movable with said holder during transportation of said heater and said holder, a fuel regulator to regulate the flow of fuel from said fuel tank and said burner, said fuel regulator being operable to raise or lower the level of fuel in said burner thereby to allow increased or decreased vaporization of said fuel in said burner, said fuel tank and said casing being positioned on said holder.

2. A self-contained camp heater as in claim 1 wherein a bail is operably connected to said holder, said bail being liftable thereby to raise said holder and transport said casing and fuel tank on said holder.

3. A heater as in claim 1 wherein said stack is removable from said casing and is storable on said holder.

4. A method to provide heat to an enclosed location comprising the steps of manually transporting a self-contained heater having a holder in which a fuel tank, a burner located within a casing and a stack removable from said casing are positioned, installing said stack on said casing with a plurality of stack segments, one of said stack segments being connectable to said casing and a further one of said stack segments allowing exhaust of combustion products to a desired location, each of said stack segments being removable from the remaining ones of said stack segments, initiating fuel flow from said fuel tank to said burner and commencing combustion of said fuel within said burner, said stack segments being positioned on and movable with said holder when said self-contained camp heater is transported.

5. A method as in claim 4 and further regulating said fuel flow.

6. Method as in claim 5 wherein said fuel passes through a regulator located between said fuel tank and said burner.

* * * * *